US011173724B1

(12) United States Patent
Zhang et al.

(10) Patent No.: US 11,173,724 B1
(45) Date of Patent: Nov. 16, 2021

(54) WOODGRAIN SUPPRESSION IN INKJET PRINTING

(71) Applicant: Electronics for Imaging, Inc., Fremont, CA (US)

(72) Inventors: Hui Zhang, Bedford, NH (US); John Peter Duffield, Stratham, NH (US)

(73) Assignee: ELECTRONICS FOR IMAGING, INC., Fremont, CA (US)

( * ) Notice: Subject to any disclaimer, the term of this patent is extended or adjusted under 35 U.S.C. 154(b) by 0 days.

(21) Appl. No.: 17/014,512

(22) Filed: Sep. 8, 2020

(51) Int. Cl.
*B41J 2/215* (2006.01)
*B41J 2/045* (2006.01)

(52) U.S. Cl.
CPC ..... *B41J 2/215* (2013.01); *B41J 2/04516* (2013.01); *B41J 2/04526* (2013.01); *B41J 2/04586* (2013.01)

(58) Field of Classification Search
CPC .... B41J 2/1408; B41J 2/14088; B41J 11/002; B41J 11/00242; B41J 11/0024; B41J 11/0022; B41J 2/215; B41J 2/04516; B41J 2/04526; B41J 2/04586; B41J 2/01; B41J 2/02; B41J 2/135; B41J 2/14; B41J 2/14008; B41J 2/14016; B41J 2/14201; B41J 2/14314
See application file for complete search history.

(56) References Cited

U.S. PATENT DOCUMENTS

| | | | | |
|---|---|---|---|---|
| 10,183,498 | B2 | 1/2019 | Barnett et al. | |
| 2008/0303851 | A1* | 12/2008 | Silverbrook | B41J 2/14427 347/12 |
| 2018/0281405 | A1* | 10/2018 | Suzuki | B41J 2/14201 |
| 2020/0331263 | A1* | 10/2020 | Benton | B41J 2/14 |

* cited by examiner

*Primary Examiner* — Kristal Feggins
(74) *Attorney, Agent, or Firm* — Perkins Coie LLP

(57) ABSTRACT

The present embodiments relate to a printing apparatus capable of mitigating/preventing instances of turbulent deviation of ink jetted from print heads when printing onto a substrate, a severe form of which looks like woodgrain. The printing apparatus can include a jet plate disposed on a subjacent surface of the printing apparatus that can include a series of apertures formed in the jet plate that are configured to receive corresponding print heads of the printing apparatus. The jet plate can also include a set of wings extending from a first end of a central portion of the jet plate. The set of wings can form a cutout portion of the jet plate that can modify a direction and/or velocity of a flow of air from the cutout portion along the printing area to mitigate/prevent a woodgrain defect occurring when distributing a material onto the substrate.

20 Claims, 6 Drawing Sheets

WOODGRAIN SUPPRESSION IN INKJET PRINTING

TECHNICAL FIELD

The present disclosure relates to printer systems and in particular to components of large-scale printing systems.

BACKGROUND

Many consumer products are packaged in containers that have consumer information and branding printed on the outside of the container. The printed design on the package serves several purposes. For instance, a printed design can assist a consumer in identifying the product or display information describing features of the product. In addition to printed designs on containers, some consumer products can include information and designs printed directly on the product.

Such printed designs may be applied to a container using a large industrial printer capable of printing large amounts of materials. However, in many instances, when printing large volumes of materials, a printed ink of a printer can be displaced from its intended target location, a severe form of this displacement can look like a woodgrain pattern. A woodgrain defect can include a printed design on a container to deviate from a desired output to resemble woodgrain on wood. The woodgrain defect can be caused by the ink droplets swirling in the space between the printing apparatus and the material being printed before the ink droplets are deposited on the material being printed. A woodgrain defect on a printed design can generally lower the quality of the printed design.

DETAILED DESCRIPTION

Figure 1:
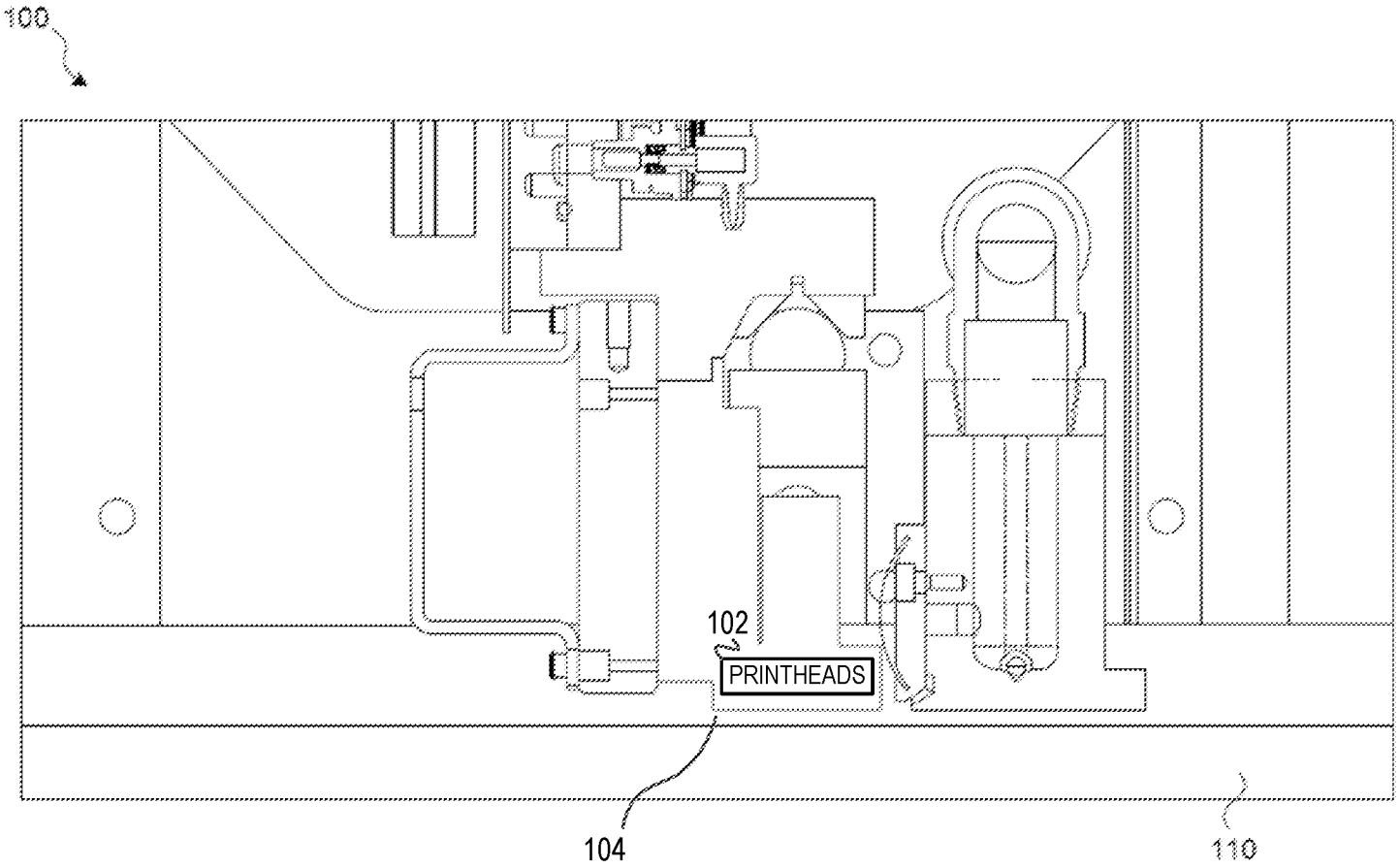
FIG. 1 depicts a printing apparatus and a substrate, in accordance with various embodiments.

In many instances, a printing apparatus (or simply a "printer") can print a material (e.g., ink) on a large volume of substrates. Printing on a substrate can either be performed by single-pass printing or scanning printing. Single-pass printing is a printing technique where the substrate can move while the printing apparatus is stationary. Scanning printing is a printing technique where the printing apparatus moves while the substrate is stationary. In both types of printing, the printing apparatus can include a jet plate with apertures and printheads located at each of the apertures in the jet plate to allow for printing a material onto a substrate.

In some instances, defects can develop in the ink placement that can alter the printed design on the substrate. One such defect can include a woodgrain defect. A woodgrain defect generally occurs when the ink droplets swirl during printing and collect in a pattern on the substrate that resembles woodgrain on a piece of wood. In many cases, a woodgrain defect can be mitigated/prevented if there is a uniform air flow between the printing apparatus and the substrate.

One straightforward approach for preventing a woodgrain & similar defects including implementing a vacuum to the printing apparatus to force air between the printing apparatus and the substrate. However, adding a vacuum to the printing apparatus includes additional installation onto the printing apparatus, which can increase resources to implement such a printing apparatus.

A printing area can include the area between the bottom of the printing apparatus and the substrate. The bottom of the printing apparatus can be defined by the jet plate and the printheads. Ambient air can flow within the printing area during printing because of the movement of the printing apparatus during scanning printing or the substrate during single-pass printing.

The printing apparatus in scanning printing or the substrate in single-pass printing can move at high speeds. This can cause the ambient air between the printing apparatus and the substrate to move rapidly. The movement of the ambient air can force the ambient air to flow between the printing apparatus and the substrate in the printing area. This airflow can be faster at the edges of the jet plate (or individual print heads) and tends to ebb and swirl more towards the edges of individual jets and even more towards the edges of the jet plate.

Further, in many instances, when movement of air between the printing apparatus and the substrate exceeds a threshold level, the printing apparatus may cause the woodgrain defect. This may be caused by turbulent air picking up droplets of ink and depositing the droplets in a location other than their intended location.

In some instances, to mitigate the woodgrain defect, a printing apparatus can direct a positive airflow in the opposite direction of the movement of the printing apparatus or in the same direction as the movement of the substrate. Airflow between the printing apparatus and the substrate at a sufficient velocity can mitigate/prevent ink droplets from being deviated or swirling and depositing in an incorrect location on the substrate.

The lack of ambient air movement in the center of the printing area can cause the ambient air to eddy. When the ambient air eddies in the printing area, it can cause droplets of ink to swirl. When the swirling ink droplets are deposited on the substrate, the droplets can gather in locations where they were not intended to fall. These locations where the ink droplets gather can create tiny hills and valleys that, when viewed together, appear like woodgrain on a piece of wood. The appearance of the woodgrain defect can negatively modify the quality of the printing.

In many cases, a technique for reducing the woodgrain defect in ink jet printing is to lower the jet plate and printheads towards the substrate. When the jet plate and printheads are lowered toward the substrate they can strike the substrate. A strike can occur when the jet plate hits the substrate. However, a strike may be undesirable because this can damage the printing apparatus or the substrate and decrease print quality. A strike can also throw off the alignment of the printer. When the substrate is not perfectly flat, either by design or because of its composition, the jet plate and the printhead may need to be raised to reduce strikes, thus increasing the likelihood of the woodgrain defect.

In other cases, another technique for reducing woodgrain defects is to force air to flow in the printing area between the bottom of the printing apparatus and the substrate using a vacuum. When the air is forced through the printing area using a vacuum, the airflow may be laminar and the small ink droplets may not swirl. The ink droplets fall in a relatively uniform curtain onto the substrate. When the curtain of ink is uniform then the woodgrain defect is generally prevented.

However, this may require a vacuum to be mounted on the printing apparatus with an air output on the front and an air intake on the back of the printing apparatus to force air through the printing area. This may include mounting additional components on the printing apparatus to force air between the printing apparatus and the substrate, thereby increasing resources utilized to perform printing tasks and a difficulty in performing the printing tasks. Additionally, air can escape out of the sides of the printing area.

The present embodiments relate to a printing apparatus that allows for airflow between the printing apparatus and the substrate without implementing additional components. Particularly, the present embodiments can channel the air that flows between the printing apparatus and the substrate to create a laminar airflow that assists the ink droplets to fall in a uniform curtain onto the substrate. The air flow can be caused by movement of the printing apparatus or the substrate during printing. The movement of the printing apparatus or the substrate can move ambient air between the printing apparatus and the substrate, thereby causing the airflow within a satisfactory level.

The present embodiments can control air flow and/or air sped across components of the printing apparatus passively (e.g., no forced air pressure or vacuum is used). This can be accomplished using features as described herein, such as tapered wings, deflector tabs, channels/slots, etc. Further, in many cases, a printing apparatus may not include print heads mounted in a jet plate. In such cases, passive control of air direction/velocity may differ.

A printing apparatus can include a series of print heads arranged in a pattern along the printing apparatus. Each print head of the series of print heads can be configured to distribute a material onto a substrate disposed within a printing area of the printing apparatus.

The printing apparatus can also include a jet plate disposed on a subjacent surface of the printing apparatus. The jet plate can include a series of apertures formed in the jet plate. The series of apertures can be disposed along the jet plate corresponding to the pattern of the series of print heads. Each aperture of the series of apertures may be configured to receive corresponding print heads of the series of print heads.

In some embodiments, the series of apertures formed in the jet plate can be substantially rectangular and are arranged in a series of rows and columns along the jet plate that correspond to the pattern of the series of print heads arranged along the printing apparatus.

In some embodiments, each of the series of print heads are disposed within each corresponding aperture of the series of apertures formed in the jet plate.

The jet plate can also include a first set of wings extending from a first end of a central portion of the jet plate relative to a horizontal axis of the jet plate. The first set of wings can form a cutout portion of the jet plate that is configured to modify a direction of a flow of air from the cutout portion along the printing area.

In some embodiments, a width of each of the first set of wings tapers such that a width of the first set of wings decreases as the first set of wings extend from the first end of the central portion of the jet plate.

In some embodiments, the jet plate can include a second set of wings extending from a second end of the central portion of the jet plate relative to the horizontal axis. The second end of the central portion can oppose the first end of the central portion relative to the horizontal axis. The second set of wings can form a second cutout portion of the jet plate that is configured to further modify the direction of the flow of air.

In some embodiments, each of the series of print heads are disposed through each corresponding aperture of the series of apertures formed in the jet plate such that the series of print heads form a series of channels between the series of print heads, the series of channels configured to further modify the direction of the flow of air moving along the printing area. The series of print heads can be disposed through each corresponding aperture of the series of apertures formed in the jet plate with a depth that does not exceed a threshold level so as to not come into contact with the substrate.

The present embodiments as described herein can increase and control a velocity of airflow between the printing apparatus and the substrate. Increasing the velocity of the airflow using the embodiments described herein can improve print quality while reducing costs and complexity of the system while also controlling the velocity of the airflow to prevent instances of turbulent deviation of ink droplets, severe forms of which look like a woodgrain defect. Particularly, any of a jet plate or a series of printheads of a printing apparatus can be designed to funnel air between the printing apparatus and the substrate at a sufficient velocity to maintain a laminar airflow that can prevent ink droplets from swirling and mitigate instances of a woodgrain defect.

In a first exemplary embodiment, a jet plate of a printing apparatus can form an opening (or a "scooped section") from a bottom portion of the jet plate. The opening can allow for ambient air to funnel ambient air between the jet plate, the printheads and the substrate. The ambient air can move at a sufficient velocity between the jet plate, the printheads and the substrate to prevent the air from eddying, allowing for the ink droplets to deposit in a uniform curtain when the air does not eddy, preventing deviation and the woodgrain defect.

In a second exemplary embodiment, a series of printheads can be exposed through a series of openings formed in the jet plate towards the substrate. The series of printheads exposed through the jet plate can create channels between the printheads, the jet plate, and the substrate through which the ambient air flows during printing. These channels can direct the ambient air between the printheads, the jet plate, and the substrate at a higher velocity, thereby creating an airflow between the jet plate, the printheads and the substrate to prevent ink droplets from swirling and causing a woodgrain defect.

While the present embodiments may use a large industrial-scale printing apparatus as an illustrative example, the present embodiments may be applied to any suitable printing apparatus. For instance, a printing apparatus can print designs used for packaging a product (e.g., manufactured goods, food). Industrial printers can print a large volume of printed products. These printers can be tooled or programed to print a wide variety of designs on a wide variety of materials.

The material that the printing apparatus prints upon can be referred to simply as a "substrate." Example substrates can include paper, wood, plastic, cardboard, composites, metal and any other type of material that would be suitable for printing.

As noted above, a printing apparatus can include a series of printheads and a jet plate. Each printhead can include a component that allows for and controls distribution of a material (e.g., ink) from the printing apparatus and onto the substrate. The series of printheads can be disposed along the printing apparatus in a design/pattern to efficiently distribute a material across the substrate. The printing apparatus can also include components that control the printheads to print a desired design.

A jet plate can include a plate disposed on a lower portion of the printing apparatus. The jet plate can include one or more apertures formed therein that are configured to receive the series of printheads. In some embodiments, the printheads can be disposed within the apertures formed in the jet plate such that the printheads are flush with the jet plate.

In some embodiments, the jet plate can include a cutout with wings formed on the outer edges of the cutout. The wings can be solid or flexible while assisting with direction of the ambient air into the printing area. The wings can assist to mitigate/prevent the ambient air from flowing out the sides of the printing area, thereby increasing the airflow velocity above a certain threshold that creates a linear airflow through the curtain of ink during printing.

FIG. 1 depicts a printing apparatus 100 and a substrate 110, in accordance with various embodiments. As shown in FIG. 1, the printing apparatus 100 can include a series of printheads 102 capable of disposing a material (e.g., ink) onto the substrate 110. The substrate 110 can be disposed subjacent to (or below) printing apparatus 100. The area between the substrate 110 and printing apparatus 100 can include printing area 104.

Figure 2:
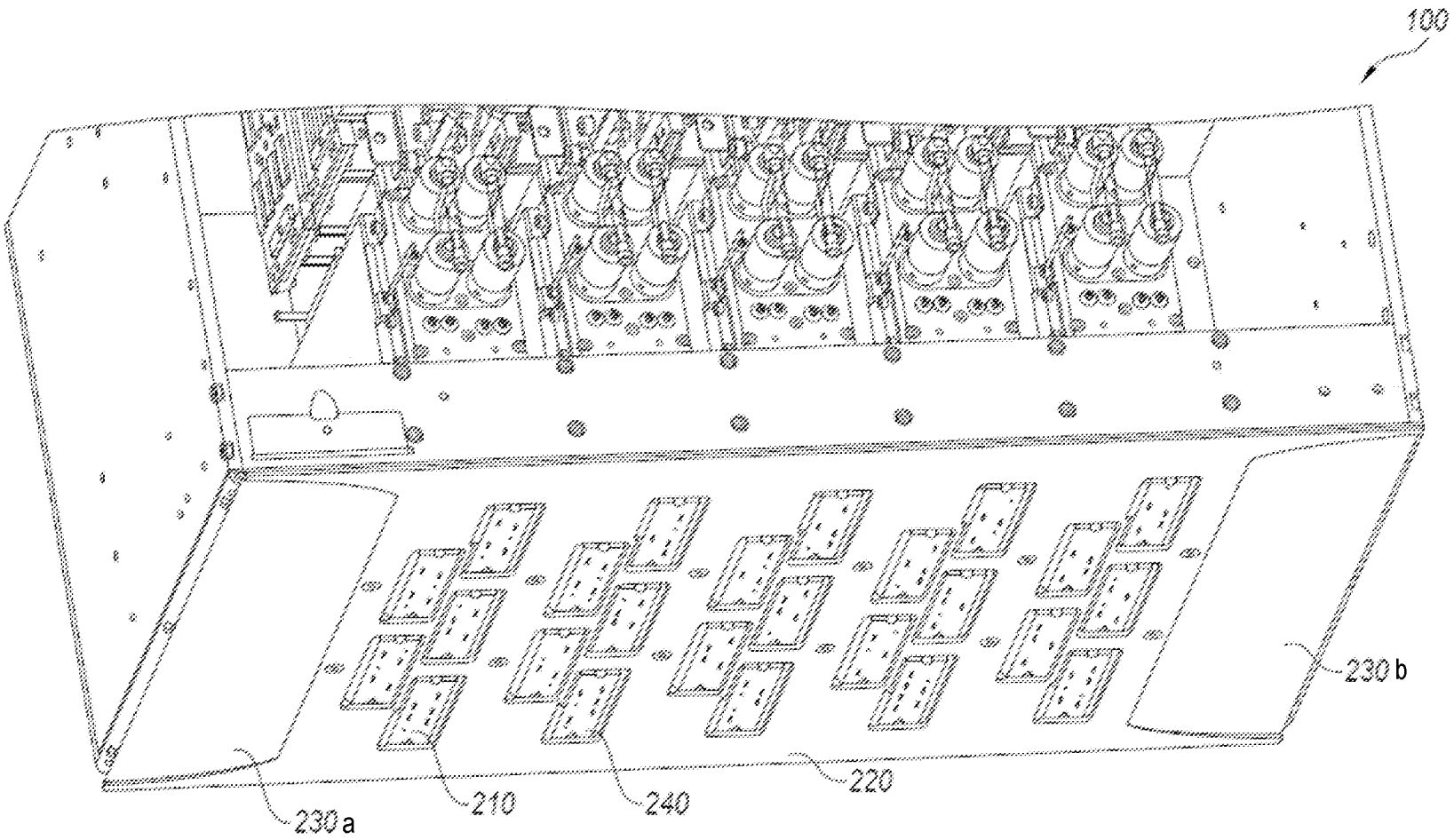
FIG. 2 is an orthogonal view of a printing apparatus, in accordance with various embodiments.

FIG. 2 is an orthogonal view of a printing apparatus 100, in accordance with various embodiments. As shown in FIG. 2, the printing apparatus 100 can include a jet plate 220. The jet plate 220 can be disposed on the bottom of the printing apparatus 100 facing the substrate 110. The jet plate 220 can form a series of apertures 240 along the jet plate 220. The apertures 240 can allow for printheads 210 to be exposed from jet plate 220 so as to print onto a substrate. The series of apertures 240 can form a pattern along the jet plate 220 that corresponds with an arrangement of the series of printheads 210.

The jet plate 220 can form a cutout 230*a-b* on any end of the jet plate 220. For instance, the jet plate 220 can include a first cutout 230*a* on a first end and a second cutout 230*b* on a second end of the jet plate 220. The cutouts 230*a-b* can include a portion of the jet plate 220 that is exposed and assists in funneling ambient air into the printing area. The structure of the jet plate 220 can allow for ambient air to flow through the printing area with a sufficient velocity to become laminar and prevent the woodgrain defect. This can allow for creation of a laminar air flow that also mitigates/prevents the air from eddying such that the ink droplets fall in their intended locations.

In some embodiments, a jet plate 220 can be modified to direct ambient air as it passes through the printing area between the printheads 210, the jet plate 220 and the substrate 110. Particularly, cutout portions (e.g., 230*a*, 230*b*) can be removed from the jet plate 220. The cutout 230*a*, 230*b* in the jet plate 220 comprise any of multiple shapes. According to one embodiment, the cutouts 230*a-b* can include wings that protrude from a center of the jet plate 220. In this embodiment, the wings can include a width that decreases as the distance from the center of the jet plate 220 increases. The wings can be parabolic, or curvilinear or linear.

In some embodiments, the cutouts 230*a-b* can include rounded edges at a transition point between the cutout portions 230*a-b* and a central portion of the jet plate 220. The rounded edge can assist to create a smooth, laminar airflow between the jet plate 220, the printheads 210 and the substrate 110.

Figure 3:
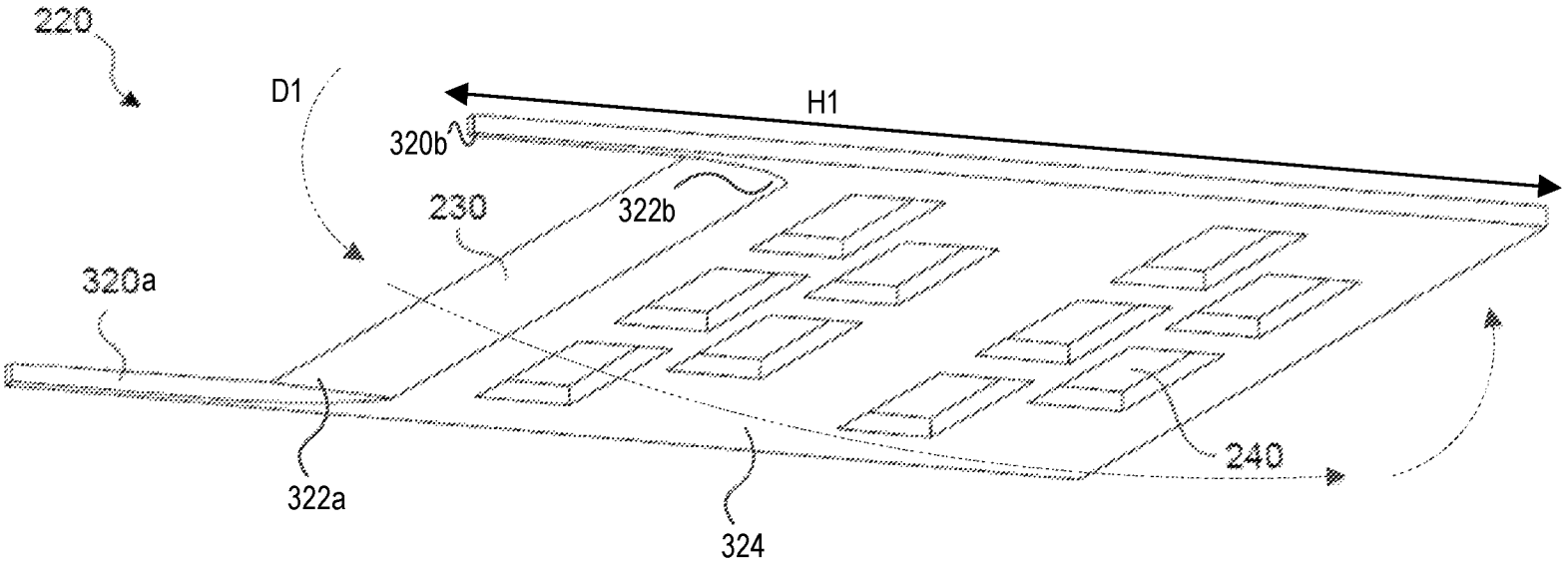
FIG. 3 is a perspective view of a jet plate, in accordance with various embodiments.

FIG. 3 is a perspective view of a jet plate 220, in accordance with various embodiments. As shown in FIG. 3, the jet plate 220 can include cutout portion 230. The cutout portion 230 can include wings 230*a-b* extending from opposing sides of the jet plate 220. The wings 320*a-b* can taper from a central portion 324 of the jet plate 220, wherein a width of the wings 320*a-b* decreases as the wings 320*a-b* extend from the central portion 324. The wings 320*a-b* can extend outward from the central portion 324 relative to a horizontal plane H1. The cutout portion 230 can include rounded edges 322*a-b* between central portion 324 and wings 320*a-b*. The rounded edges 322*a-b* can improve airflow as the ambient air is directed into the printing area.

As noted above, the jet plate 220 can direct an air flow through a printing area. For instance, as illustrated in FIG. 3, an airflow can be directed through jet plate 220 via an air flow direction D1. Air can flow via direction D1 from the cutout portion 230 and by the series of apertures 240 in the central portion 324 of the jet plate 220. The wings 320*a-b* can keep the direction D1 of the air between the wings 320*a-b* in the cutout portion 230 to prevent air from leaking out of the sides of the printing area during printing.

Figure 4:
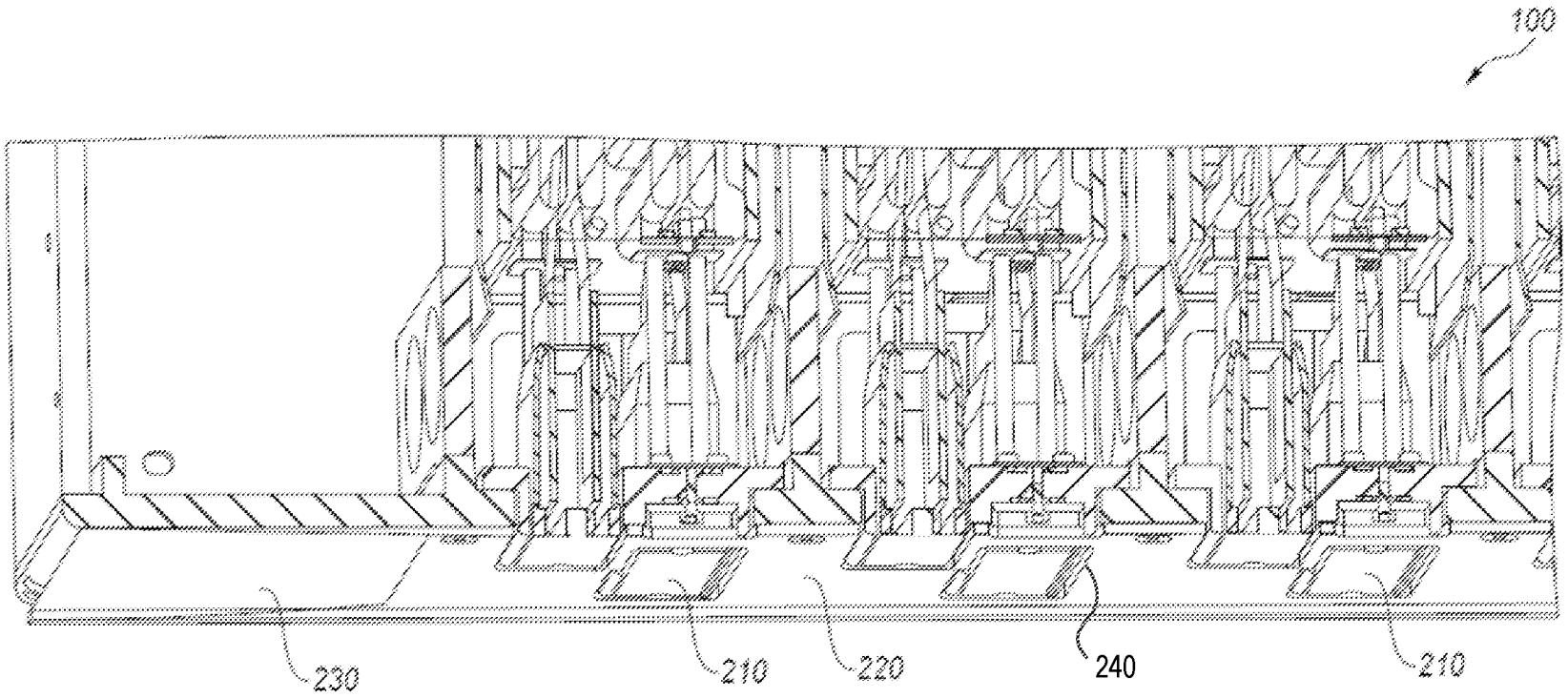
FIG. 4 is a first side view of a printing apparatus, in accordance with various embodiments.

FIG. 4 is a first side view of a printing apparatus 100, in accordance with various embodiments. As shown in FIG. 4, the jet plate 220 can include cutout portion 230 that can facilitate funneling of an airflow into a printing area. As noted above, the series of printheads 210 can expose from apertures 240 formed in jet plate 220.

Figure 5:
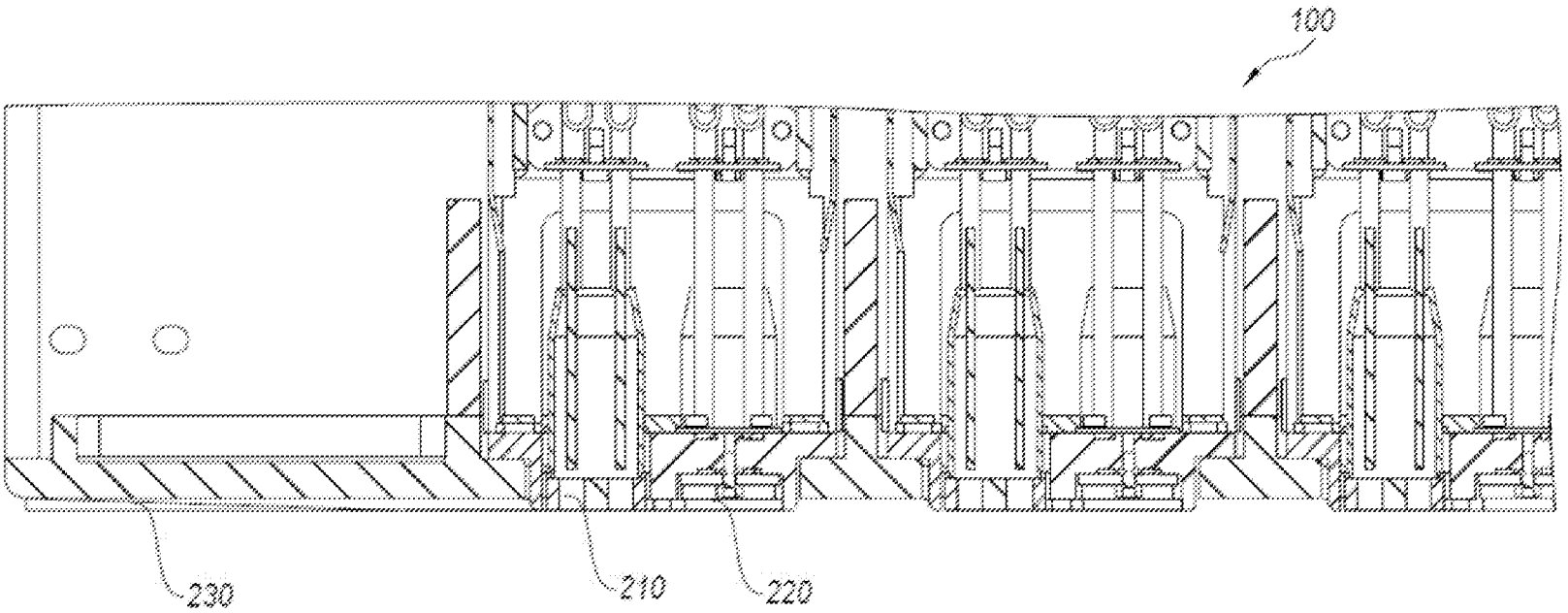
FIG. 5 is a second side view of the printing apparatus, in accordance with various embodiments.

FIG. 5 is a second side view of the printing apparatus 100, in accordance with various embodiments. As shown in FIG. 5, the printing apparatus 100 can include the cutout portion 230 in the jet plate 220 for funneling ambient air into the printing area. In some embodiments, the printheads 210 can be flush with the jet plate 220.

Figure 6:
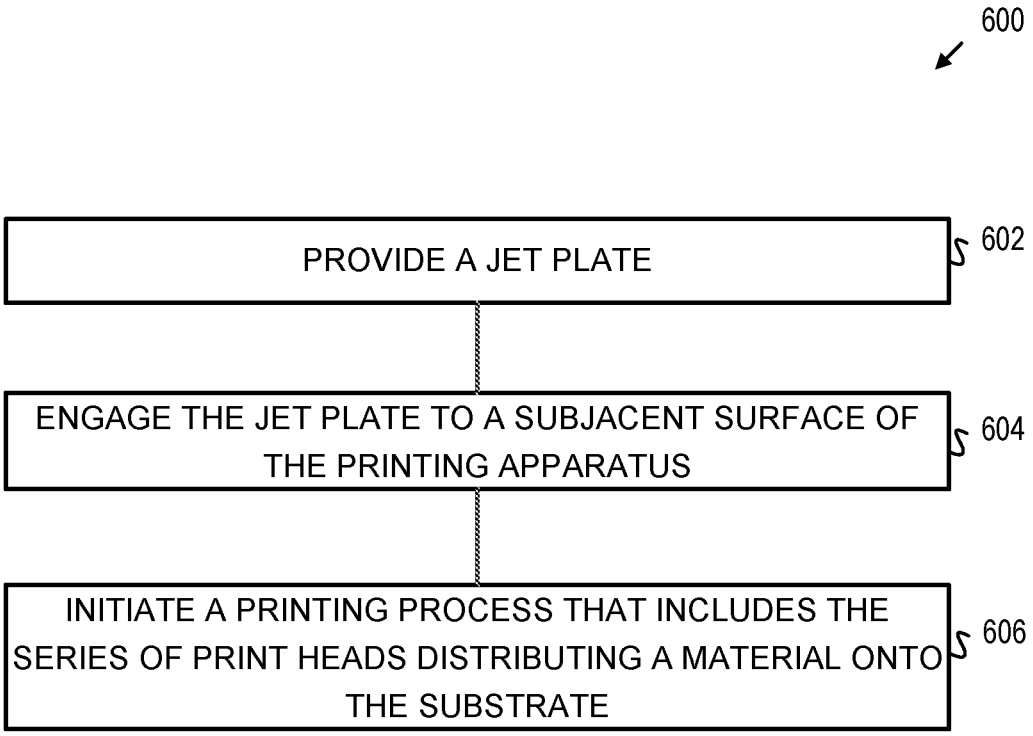
FIG. 6 is a block diagram illustrating an example method for performing a printing process via a printing apparatus, in accordance with various embodiments.

FIG. 6 is a block diagram 600 illustrating an example method for performing a printing process via a printing apparatus, in accordance with various embodiments. The method can include providing a jet plate (block 602). The jet plate can include a series of apertures formed in the jet plate. The series of apertures can be disposed along the jet plate corresponding to the pattern of the series of print heads. The jet plate can also include a first set of wings extending from a first end of a central portion of the jet plate relative to a horizontal axis of the jet plate. The first set of wings can form a cutout portion of the jet plate that is configured to modify a direction of a flow of air from the cutout portion along a printing area between the printing apparatus and a substrate.

The method can also include engaging the jet plate to a subjacent surface of the printing apparatus (block 604). The printing apparatus can include a series of print heads arranged in a pattern along the printing apparatus. Each print head can be configured to dispose within each corresponding aperture in the series of apertures formed in the jet plate.

The method can include initiating a printing process that includes the series of print heads distributing a material onto the substrate (block 606).

In some embodiments, the method includes disposing each print head of the series of print heads through each corresponding aperture of the series of apertures formed in the jet plate such that the series of print heads form a series of channels between the series of print heads, the series of channels configured to further modify the direction of the flow of air moving along the printing area. The series of print heads can be disposed through each corresponding aperture of the series of apertures formed in the jet plate with a depth that does not exceed a threshold level so as to not come into contact with the substrate.

CONCLUSION

The foregoing description of various embodiments of the claimed subject matter has been provided for the purposes of illustration and description. It is not intended to be exhaustive or to limit the claimed subject matter to the precise forms disclosed. Many modifications and variations will be apparent to one skilled in the art. Embodiments were chosen and described in order to best describe the principles of the invention and its practical applications, thereby enabling those skilled in the relevant art to understand the claimed subject matter, the various embodiments, and the various modifications that are suited to the particular uses contemplated.

Although the Detailed Description describes certain embodiments and the best mode contemplated, the technology can be practiced in many ways no matter how detailed the Detailed Description appears. Embodiments may vary considerably in their implementation details, while still being encompassed by the specification. Particular terminology used when describing certain features or aspects of various embodiments should not be taken to imply that the terminology is being redefined herein to be restricted to any specific characteristics, features, or aspects of the technology with which that terminology is associated. In general, the terms used in the following claims should not be construed to limit the technology to the specific embodiments disclosed in the specification, unless those terms are explicitly defined herein. Accordingly, the actual scope of the technology encompasses not only the disclosed embodiments, but also all equivalent ways of practicing or implementing the embodiments.

The language used in the specification has been principally selected for readability and instructional purposes. It may not have been selected to delineate or circumscribe the subject matter. It is therefore intended that the scope of the technology be limited not by this Detailed Description, but rather by any claims that issue on an application based hereon. Accordingly, the disclosure of various embodiments is intended to be illustrative, but not limiting, of the scope of the technology as set forth in the following claims.

The invention claimed is:

1. A printing apparatus comprising:

a series of print heads arranged in a pattern along the printing apparatus, each print head of the series of print heads configured to distribute a material onto a substrate disposed within a printing area of the printing apparatus; and a jet plate disposed on a subjacent surface of the printing apparatus, the jet plate including:

a series of apertures formed in the jet plate, the series of apertures disposed along the jet plate corresponding to the pattern of the series of print heads, wherein each aperture of the series of apertures is configured to receive corresponding print heads of the series of print heads; and a first set of wings extending from a first end of a central portion of the jet plate relative to a horizontal axis of the jet plate, wherein the first set of wings form a first cutout portion of the jet plate that is configured to modify a direction of a flow of air from the first cutout portion along the printing area.

2. The printing apparatus of claim 1, wherein a width of each of the first set of wings tapers such that a width of the first set of wings decreases as the first set of wings extend from the first end of the central portion of the jet plate.

3. The printing apparatus of claim 1, wherein the series of apertures formed in the jet plate are substantially rectangular and are arranged in a series of rows and columns along the jet plate that correspond to the pattern of the series of print heads arranged along the printing apparatus.

4. The printing apparatus of claim 1, wherein each of the series of print heads are disposed within each corresponding aperture of the series of apertures formed in the jet plate.

5. The printing apparatus of claim 1, wherein the jet plate further includes:

a second set of wings extending from a second end of the central portion of the jet plate relative to the horizontal axis, the second end of the central portion opposing the first end of the central portion relative to the horizontal axis.

6. The printing apparatus of claim 5, wherein the second set of wings form a second cutout portion of the jet plate that is configured to further modify the direction of the flow of air when the print heads are moving in opposing directions.

7. The printing apparatus of claim 1, wherein each of the series of print heads are disposed through each corresponding aperture of the series of apertures formed in the jet plate such that the series of print heads form a series of channels between the series of print heads, the series of channels configured to further modify the direction of the flow and a velocity of air moving along the printing area.

8. A jet plate capable of engaging to a printing apparatus, the jet plate comprising:

a series of apertures formed in the jet plate, the series of apertures arranged in a pattern along the jet plate, wherein each aperture of the series of apertures is configured to receive a corresponding print head of a series of print heads of the printing apparatus; and a first set of wings extending from a first end of a central portion of the jet plate relative to a horizontal axis of the jet plate, wherein the first set of wings form a first cutout portion of the jet plate that is configured to modify a direction of a flow of air from the first cutout portion along a printing area disposed subjacent to the jet plate.

9. The jet plate of claim 8, wherein the first cutout portion channels the flow of air to create a higher velocity of the air and a lower turbulence in the air between the series of print heads and a substrate.

10. The jet plate of claim 8, wherein a width of each of the first set of wings tapers such that a width of the first set of wings decreases as the first set of wings extend from the first end of the central portion of the jet plate.

11. The jet plate of claim 8, wherein each of the series of print heads are configured to be disposed within each corresponding aperture of the series of apertures formed in the jet plate.

12. The jet plate of claim 8, wherein each of the series of print heads are configured to be disposed through each corresponding aperture of the series of apertures formed in the jet plate such that the series of print heads form a series of channels between the series of print heads, the series of channels configured to further modify the direction of the flow and a velocity of air moving along the printing area.

13. The jet plate of claim 8, further including:

a second set of wings extending from a second end of the central portion of the jet plate relative to the horizontal axis, the second end of the central portion opposing the first end of the central portion relative to the horizontal axis, wherein the second set of wings form a second cutout portion of the jet plate that is configured to further modify the direction of the flow of air when the print heads are travelling in opposing directions.

14. A method for performing a printing process via a printing apparatus, the method comprising:

providing a jet plate, the jet plate including:

a series of apertures formed in the jet plate, the series of apertures disposed along the jet plate corresponding to a pattern of a series of print heads; and a first set of wings extending from a first end of a central portion of the jet plate relative to a horizontal axis of the jet plate, wherein the first set of wings form a first cutout portion of the jet plate that is configured to modify a direction of a flow of air from the first cutout portion along a printing area between the printing apparatus and a substrate;

engaging the jet plate to a subjacent surface of the printing apparatus, the printing apparatus including the series of print heads arranged in the pattern along the printing apparatus, wherein each print head is configured to be disposed within each corresponding aperture in the series of apertures formed in the jet plate; and initiating the printing process that includes the series of print heads distributing a material onto the substrate.

15. The method of claim 14, further comprising:

disposing each print head of the series of print heads through each corresponding aperture of the series of apertures formed in the jet plate such that the series of print heads form a series of channels between the series of print heads, the series of channels configured to further modify the direction of the flow of air moving along the printing area.

16. The method of claim 15, wherein the series of print heads are disposed through each corresponding aperture of the series of apertures formed in the jet plate with a depth that does not exceed a threshold level so as to not come into contact with the substrate.

17. The method of claim 14, wherein a width of each of the first set of wings tapers such that a width of the first set of wings decreases as the first set of wings extend from the first end of the central portion of the jet plate.

18. The method of claim 14, wherein the series of apertures formed in the jet plate are substantially rectangular and are arranged in a series of rows and columns along the jet plate that correspond to the pattern of the series of print heads arranged along the printing apparatus.

19. The method of claim 14, wherein the jet plate forms a rounded edge between each wing of the first set of wings and the central portion of the jet plate.

20. The method of claim 14, wherein the jet plate further includes:

a second set of wings extending from a second end of the central portion of the jet plate relative to the horizontal axis, the second end of the central portion opposing the first end of the central portion relative to the horizontal axis, wherein the second set of wings form a second cutout portion of the jet plate that is configured to further modify the direction of the flow of air.

* * * * *